US006748704B2

(12) United States Patent
Eguchi et al.

(10) Patent No.: US 6,748,704 B2
(45) Date of Patent: Jun. 15, 2004

(54) FACTORY LAYOUT

(75) Inventors: Koji Eguchi, Tokyo (JP); Shintaro Matsuda, Tokyo (JP); Satoru Souda, Tokyo (JP); Akiko Sakai, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 09/784,024

(22) Filed: Feb. 16, 2001

(65) Prior Publication Data

US 2002/0046518 A1 Apr. 25, 2002

(30) Foreign Application Priority Data

Oct. 19, 2000 (JP) ..... 2000-319050

(51) Int. Cl.[7] ..... E04H 9/00; E04H 1/00

(52) U.S. Cl. ..... 52/79.1; 52/79.7; 52/234; 52/DIG. 10

(58) Field of Search ..... 52/79.1, 234, 106, 52/DIG. 10, 79.4, 79.7, 236.1, 82

(56) References Cited

U.S. PATENT DOCUMENTS

| | | | | | |
|---|---|---|---|---|---|
| 2,358,704 | A | * | 9/1944 | Goudy | 52/236.1 |
| D172,340 | S | * | 6/1954 | Deam | |
| 2,756,584 | A | * | 7/1956 | Shelton | 52/236.1 |
| 3,068,534 | A | * | 12/1962 | Hu | |
| 3,152,366 | A | * | 10/1964 | McCrory | 52/79.4 |
| 3,372,518 | A | * | 3/1968 | Rensch | 52/223.7 |
| 3,543,455 | A | * | 12/1970 | Walsh | 52/64 |
| D227,456 | S | * | 6/1973 | Fulmer | |
| 3,791,080 | A | * | 2/1974 | Sjoberg | 52/79.4 |
| D236,461 | S | * | 8/1975 | Fairburn | |
| 4,870,832 | A | * | 10/1989 | Crawley | 62/89 |
| 4,879,850 | A | * | 11/1989 | Glassco et al. | 52/82 |
| 5,413,165 | A | * | 5/1995 | Wylie | 165/208 |
| 5,690,234 | A | * | 11/1997 | Rhead et al. | 211/22 |
| 5,789,931 | A | * | 8/1998 | Meyer et al. | 324/765 |
| 6,109,049 | A | * | 8/2000 | Wetherell | 62/231 |
| 6,279,277 | B1 | * | 8/2001 | Zittmayr | 52/236.1 |
| 6,318,108 | B1 | * | 11/2001 | Holstein et al. | 62/279 |
| 6,439,466 | B2 | * | 8/2002 | Fikes | 236/11 |

FOREIGN PATENT DOCUMENTS

| | | |
|---|---|---|
| JP | 3-241176 | 10/1991 |
| JP | 2000-154661 | 6/2000 |

OTHER PUBLICATIONS

Headquaters of the United States Department of Defense—THE PENTAGON, http://www.defenselink.mil/pubs/pentagon/about/html.*

Dear sidetracked http://ask.yahoo.com/ask/20010301.html.*

Taiwanese "Prenotice of Rejection", Kingson LI, Union Patent Service Center, Mar. 1, 2002 (with English Translation).

* cited by examiner

*Primary Examiner*—Carl D. Friedman
*Assistant Examiner*—Kevin McDermott
(74) *Attorney, Agent, or Firm*—McDermott, Will & Emery

(57) ABSTRACT

A factory layout includes a plurality of substantially triangle units provided in radial directions. The triangle units are combined so as to form a polygonal shape including a triangle shape as a whole. The empty regions with an air-conditioning facility are provided at a part of the central portion of the polygonal shape.

14 Claims, 4 Drawing Sheets

FACTORY LAYOUT

BACKGROUND OF THE INVENTION

1. Field of the Invention

The present invention relates to a layout technique to factory design and facility arrangement in various manufacturing plants.

2. Discussion of Background

Most of conventional factory buildings have been formed in a rectangular shape as shown in FIG. 4. In FIG. 4, the outermost rectangular line represents the contour of a factory building 1, where many and small rectangular lines represent facilities 2 installed in the factory building 1.

In manufacturing plants which use facilities in a one-way manufacturing flow, it is enough to provide the facilities along the moving line. However, in manufacturing plants where the manufacture is complicated and facilities are repetitively used (such as semiconductor device manufacturing plants), the moving line of articles is complicated, and the articles are, in some cases, required to be inconveniently conveyed from one end to the other end in the plants even when a single process is completed.

In addition, there have been problems that there is no partition for air conditioning even when combustible gas or toxic gas is treated, that limitations on an escape route for ensuring an escape area require to make factory buildings in an elongated rectangular shape, and that the elongated rectangular shape deteriorates the moving line and provides restrictions on model change in articles to be manufactured or enlargement of the factories. In order to solve these problems, a sophisticated FA (Factory Automation) conveyance system has been required.

JP-A-3241176 entitled "Building Layout Structure For Semiconductor Device Manufacturing Plants" has proposed a building structure in a circular or polygonal shape. This application has proposed that an FA region be provided in a central position.

It is an object of the present invention to solve these problems, and to provide an arrangement capable of enhancing safety and making the moving line of articles to be manufactured effective with the enlargement of a factory taken into account, which have been not considered.

SUMMARY OF THE INVENTION

According to a first aspect of the present invention, there is provided a factory layout comprising a plurality of substantially triangular units provided in radial directions, the triangular units being combined so as to form a polygonal shape including a triangular shape as a whole in plan; and empty regions with an air-conditioning facility provided at a part of a central portion of the triangular shape.

According to a second aspect of the present invention, another empty region with an air-conditioning facility is provided in an expanded region outside an outer contour of the polygonal shape.

According to a third aspect of the present invention, the respective triangular units are provided with partitions for air-conditioning.

According to a fourth aspect of the present invention, adjacent triangular units include facilities having a higher frequency in movement of products to be fabricated between the adjacent triangular units than the movement of the products between the adjacent triangular units and other triangular units.

According to a fifth aspect of the present invention, facilities are provided in the order of higher frequencies of use per time unit from a position close to the central portion or to a shared conveyance passage.

According to a sixth aspect of the present invention, a factory building having a similar shape can be added for expansion. At least one triangular unit of the added factory building has a contour closely provided or coupled with a contour of a given triangular unit in the original factory building. The facilities of the at least one triangular unit are shared more with the facilities of the given triangular unit of the original factory building than other triangular units of the original factory building.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

Embodiment 1

Figure 1:
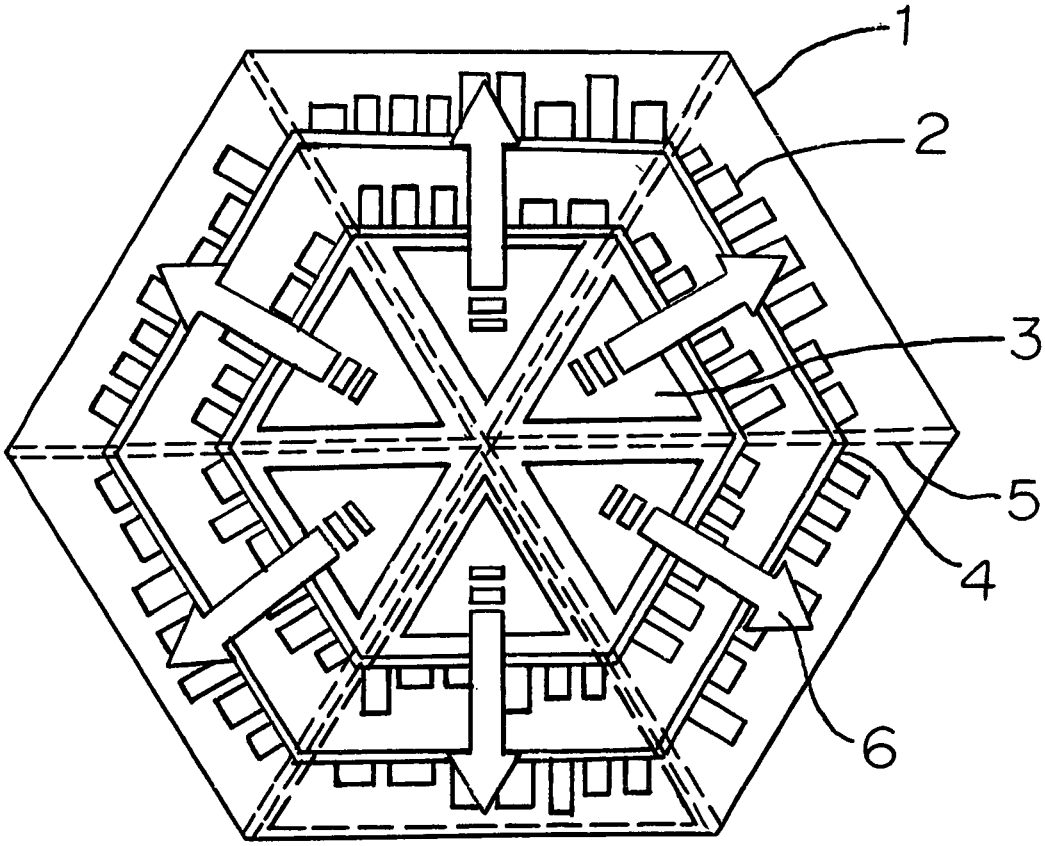
FIG. 1 is a plan view of the factory layout according to a first embodiment of the present invention.

In FIG. 1 is shown a plan view of the factory layout according to a first embodiment of the present invention. In FIG. 1, reference numeral 1 designates a factory building, reference numeral 2 designates a facility installed in the factory building 1, reference numeral 3 designates an empty area (air conditioning/escape area), reference numeral 4 designates a passage, and reference numeral 5 designates a passage with an air conditioning partition.

As shown in FIG. 1, the empty area 3 is provided at a central portion in the factory building to ensure an escape region for emergency situations. The factory building is formed in a hexagonal shape in plan, and facilities are arranged along the respective sides of the hexagonal contour so as to fit to manufacturing processes. For example, in the case of semiconductor device manufacturing plants where a cycle of pretreatment→impurity doping→film formation/heat treatment/diffusion→lithography→machining→inspection is repeated several times, six groups of facilities can be arranged along the respective sides of the layout to convey articles to be fabricated in loop fashion in accordance with a required process flow.

In each of the groups, the facilities can be arranged inwardly, i.e., closer to the center of the factory building in the order of higher frequencies of use, or closer to a shared conveyance passage 5 to shorten the moving line of the articles to be conveyed along the relevant loop, improving the efficiency in fabrication. In the first embodiment, if articles to be fabricated are not conveyed in accordance with this process flow, i.e., if articles to be fabricated are conveyed from film formation directly to inspection for instance, the articles can be conveyed through a passage 5 across the center to shorten the length of the moving line. In addition, the six triangular units in a factory building can have partitions 5 provided in radial directions between adjoining triangular units as shown in. FIG. 1 to carry out independent air conditioning in the respective units, preventing flames or toxic gas from spreading to another unit. Adjacent triangular units may include facilities having a higher frequency of the movement of articles to be fabricated between the adjacent units than the movement of articles to be fabricated between the adjacent units and the other units, making the facility arrangement effective and shortening the moving distance of the articles.

Embodiment 2

Figure 2:
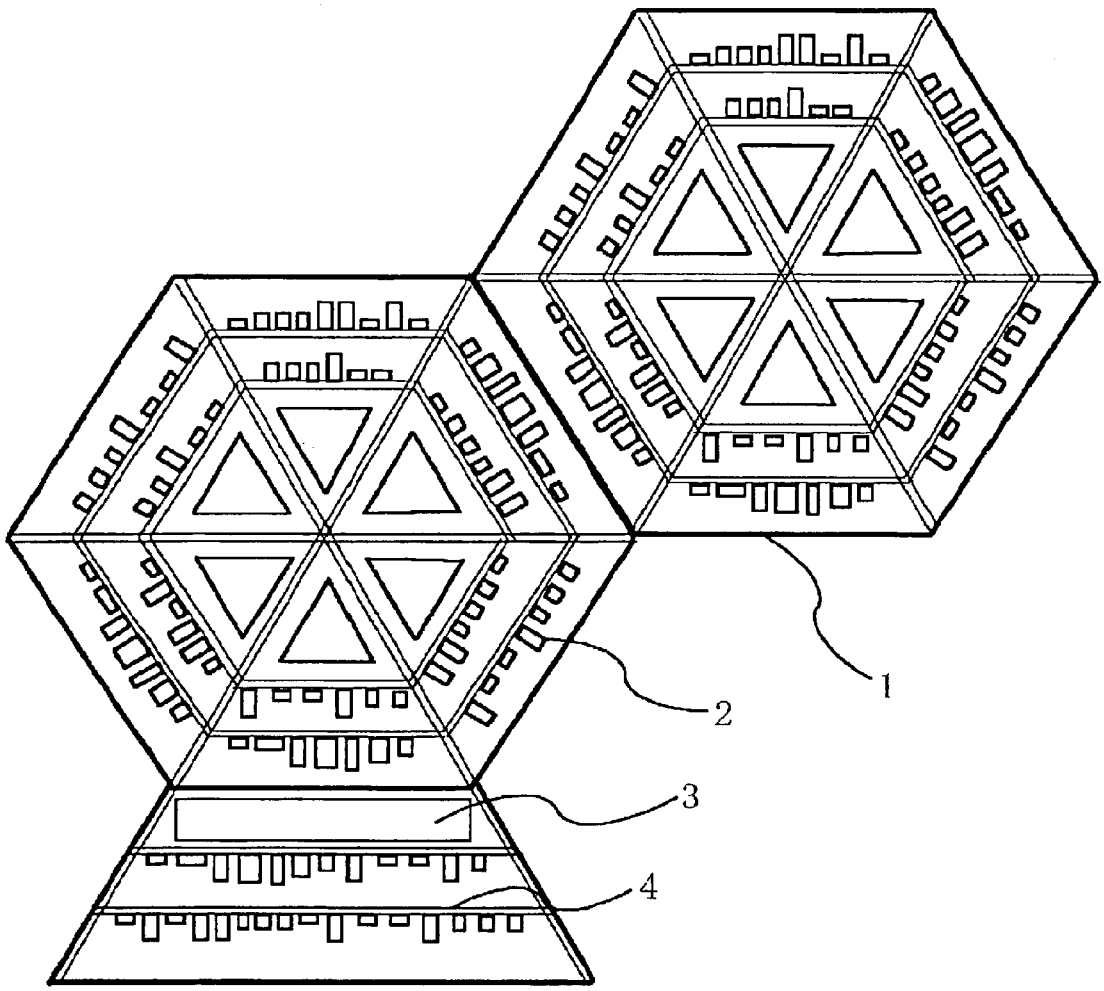
FIG. 2 is a plan view of the factory layout according to a second embodiment of the present invention.

In FIG. 2 is shown a plan view of the factory layout according to a second embodiment of the present invention, wherein two factory buildings having similar forms are connected together. The coupled triangular units of the factory buildings may include many shared facilities 2, sharing the facilities 2 of the coupled units easily in terms of distance even if different types of articles are fabricated in the respective factory buildings. This arrangement can improve the efficiency of equipment investment in a shared area, leading the investment to be saved. If a triangular unit requires increased capacity, that unit can be expanded outwardly so as to arrange the facilities in parallel with the outermost side of this unit as shown, coping with the requirement. In this case, the expanded area may include an escape area 3 as shown, ensuring the safety in terms of disaster prevention.

Embodiment 3

Figure 3:
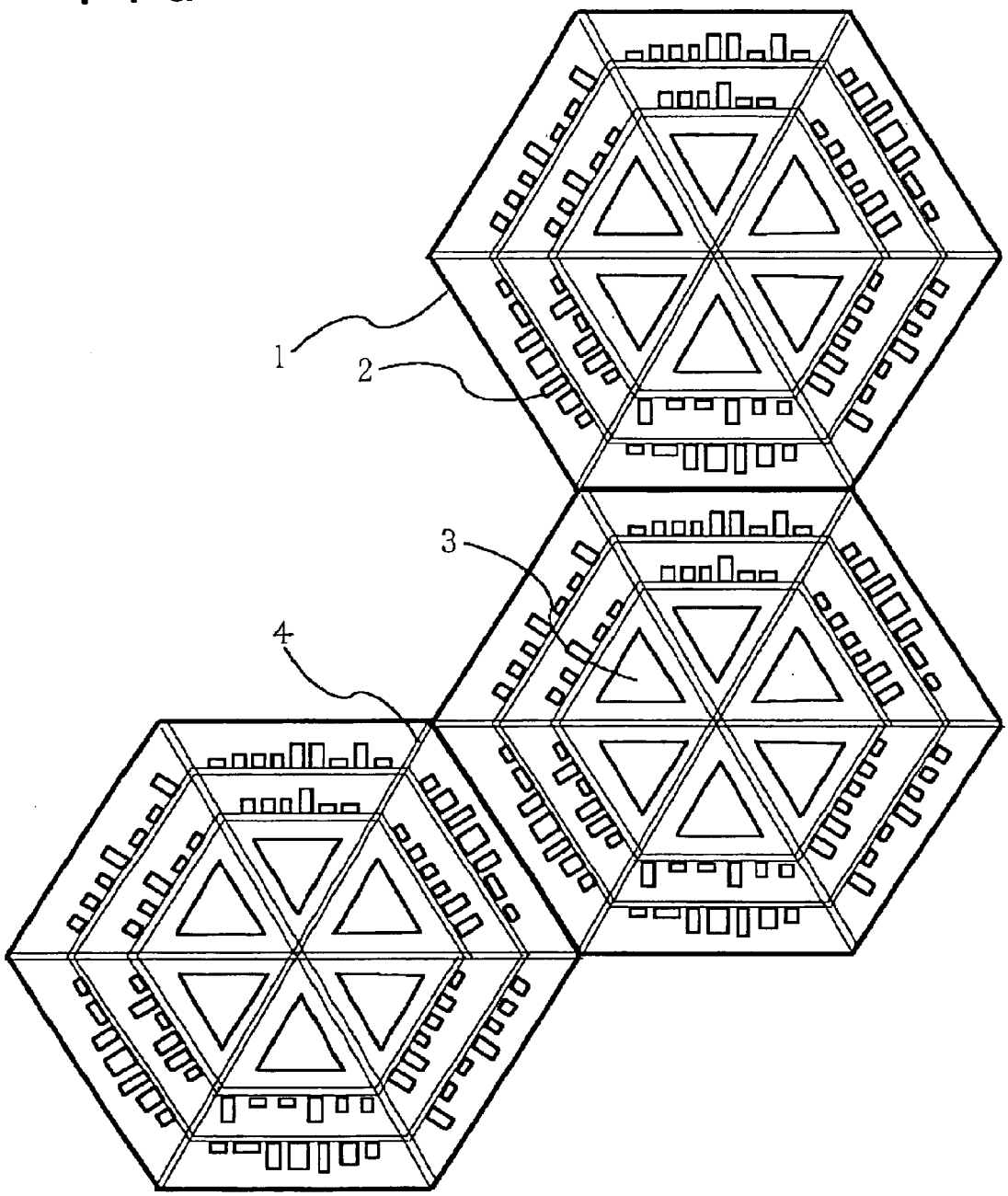
FIG. 3 is a plan view of the factory layout according to a third embodiment of the present invention.
Figure 4:
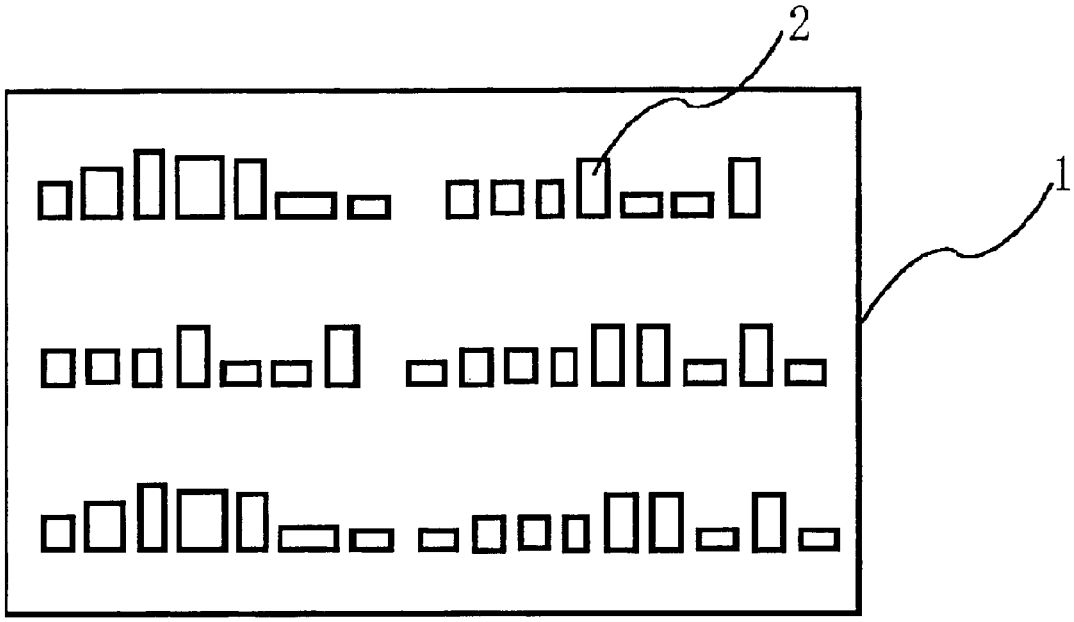
FIG. 4 is a plan view of a conventional factory layout.

In FIG. 3 is shown a plan view of the factory layout according to a third embodiment of the present invention, wherein the factory is expanded to include three factory buildings having similar forms. In accordance with the third embodiment, the facilities 2 that are shared by different types of products (e.g., facilities for product inspection) are arranged in the coupled triangular units of adjacent factory buildings, and other facilities (e.g., facilities peculiar to specific products or their types and liable to contaminate other areas by toxic gas or another chemical substance) can be arranged in an area apart from the shared area.

In accordance with the first aspect of the present invention, the factory layout comprises the plurality of substantially triangular units provided in radial directions, the triangular units being combined so as to form a polygonal shape including a triangular shape as a whole; and the empty regions with an air-conditioning facility provided at a part of the central portion of the polygonal shape. As a result, it is possible to ensure an escape region in terms of safety.

In accordance with the second aspect of the present invention, another empty region with an air-conditioning facility is provided in an expanded region outside an outer contour of the factory layout. As a result, it is possible to enlarge facility capability with an escape area for safety ensured.

In accordance with the third aspect of the present invention, the respective triangular units are provided with partitions for air-conditioning. As a result, the spread of smoke to another triangular unit can be delayed in an emergency, such as fire.

In accordance with the fourth to sixth aspects of the present invention, the proposed arrangement can provide effective facility arrangement, and shorten or optimize the moving distance of the article in the moving line. When factory buildings having a similar shape are coupled, a facility can be shared by the factory buildings to provide higher efficiency by saving investment.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application No. 2000-319050 filed on Oct. 19, 2000 including specification, claims, drawings and summary are incorporated herein by reference in its entirety.

What is claimed is:

1. A factory layout comprising:

at least two factory buildings each having a polygonal shape, each of the factory buildings including a plurality of substantially triangular units in radial directions;

each of the factory buildings having a part of a central portion provided with an empty region with an air-conditioning facility;

wherein said at least two factory buildings comprise adjacent factory buildings being connected together at outer contours, wherein the adjacent factory buildings are configured to share facilities, wherein a pair of triangular units are disposed adjacent each other and include facilities having a higher frequency in movement of products between said pair of triangular units than the movement of products between each of said pair of triangular units and other triangular units.

2. The factory layout according to claim 1, wherein another empty region with an air-conditioning facility is provided in an extended region outside an outer contour of the polygonal shape.

3. The factory layout according to claim 1, wherein the respective triangular units are provided with partitions for air-conditioning.

4. The factory layout according to claim 1, wherein when a factory building having a similar shape to said at least two factory buildings is added for expansion, a first substantially triangular unit of the added factory building has an outer contour that is coupled to a second substantially triangular unit of at least one of said at least two factory buildings, said first substantially triangular unit shares more facilities with said second substantially triangular unit than other substantially triangular units of said at least one of said at least two factory buildings.

5. The factory layout according to claim 1, wherein a partition between adjoining areas between the at least two factory buildings and/or between two of the substantially triangular units is removed so as to form a common floor therebetween.

6. The factory layout according to claim 1, wherein said polygonal shape includes at least five sides.

7. The factory layout according to claim 1, wherein said at least two factory buildings are semiconductor device manufacturing plants.

8. A factory layout comprising:

at least two factory buildings each having a polygonal shape, each of the factory buildings including a plurality of substantially triangular units in radial directions;

each of the factory buildings having a part of a central portion provided with an empty region with an air-conditioning facility;

wherein said at least two factory buildings comprise adjacent factory buildings being connected together at outer contours, wherein the adjacent factory buildings are configured to share facilities, wherein facilities are provided in the order of higher frequencies of use per time unit from a position close to the central portion or to a shared conveyance passage.

9. The factory layout according to claim 8, wherein another empty region with an air-conditioning facility is provided in an extended region outside an outer contour of the polygonal shape.

10. The factory layout according to claim 8, wherein the respective triangular units are provided with partitions for air-conditioning.

11. The factory layout according to claim 8, wherein when a factory building having a similar shape to said at least two factory buildings is added for expansion, a first substantially triangular unit of the added factory building has an outer contour that is coupled to a second substantially triangular unit of at least one of said at least two factory buildings, said first substantially triangular unit shares more facilities with said second substantially triangular unit than other substantially triangular units of said at least one of said at least two factory buildings.

12. The factory layout according to claim 8, wherein a partition between adjoining areas between the at least two factory buildings and/or between two of the substantially triangular units is removed so as to form a common floor therebetween.

13. The factory layout according to claim 8, wherein said polygonal shape includes at least five sides.

14. The factory layout according to claim 8, wherein said at least two factory buildings are semiconductor device manufacturing plants.

* * * * *